US007951761B2

(12) United States Patent
Gonzalez

(10) Patent No.: US 7,951,761 B2
(45) Date of Patent: May 31, 2011

(54) CLEANING COMPOSITIONS FOR REMOVING ORGANIC DEPOSITS IN HARD TO REACH SURFACES

(76) Inventor: Gustavo M. Gonzalez, Pembroke Pines, FL (US)

( * ) Notice: Subject to any disclaimer, the term of this patent is extended or adjusted under 35 U.S.C. 154(b) by 0 days.

(21) Appl. No.: 12/582,106

(22) Filed: Oct. 20, 2009

(65) Prior Publication Data

US 2010/0041582 A1 Feb. 18, 2010

Related U.S. Application Data

(63) Continuation of application No. 10/899,216, filed on Jul. 26, 2004, now Pat. No. 7,625,855, which is a continuation of application No. 09/945,053, filed on Aug. 31, 2001, now Pat. No. 6,767,874, which is a continuation-in-part of application No. 09/372,198, filed on Aug. 11, 1999, now Pat. No. 6,284,056.

(60) Provisional application No. 60/096,091, filed on Aug. 11, 1998.

(51) Int. Cl.
*C11D 17/00* (2006.01)

(52) U.S. Cl. ..... 510/109; 510/397

(58) Field of Classification Search ..... 510/109, 510/397

See application file for complete search history.

(56) References Cited

U.S. PATENT DOCUMENTS 4,652,375 A * 3/1987 Heilweil et al. ..... 210/642
4,879,042 A * 11/1989 Hanson et al. ..... 210/642

* cited by examiner

*Primary Examiner* — Gregory E Webb

(74) *Attorney, Agent, or Firm* — Patent Central LLC; Stephan A. Pendorf; Katherine E. Dover

(57) ABSTRACT

A cleaning composition for removing organic deposits from hard to reach surfaces. In its basic embodiment, the cleaning composition comprises: a) a water miscible solvent; b) an inorganic salt; and c) water. The amount of the inorganic salt is at least 20% of the total composition by weight, with at least some of the salt existing in crystalline form at 20° C.

19 Claims, No Drawings

CLEANING COMPOSITIONS FOR REMOVING ORGANIC DEPOSITS IN HARD TO REACH SURFACES

The disclosures of all previous applications of the present invention are incorporated herein by reference in their entirety. This application is a Continuation Application of pending prior parent application Ser. No. 10/899,216 filed Jul. 26, 2004, entitled "CLEANING COMPOSITIONS FOR REMOVING ORGANIC DEPOSITS IN HARD TO REACH SURFACES," allowed on Jul. 15, 2009, which is a Continuation Application of pending prior parent application Ser. No. 09/945,053 filed on Aug. 31, 2001, entitled "CLEANING COMPOSITIONS FOR REMOVING ORGANIC DEPOSITS IN HARD TO REACH SURFACES," allowed on Mar. 11, 2004, issuing on Jul. 27, 2004 as U.S. Pat. No. 6,767,874, which is a Continuation-in-Part Application of pending prior parent application Ser. No. 09/372,198 filed Aug. 11, 1999, and issuing as U.S. Pat. No. 6,284,056 on Sep. 4, 2001, entitled "SMOKER'S PIPE CLEANER AND METHOD OF USE", which is a Non-Provisional Application of Provisional Application No. 60/096,091, filed Aug. 11, 1998.

BACKGROUND OF THE INVENTION

1. Field of the Invention

The present invention concerns an abrasive-containing liquid cleaning composition for removing organic deposits from hard to reach surfaces and a method of use thereof. More specifically, the invention concerns to an easy to rinse cleaning composition that cleans and disinfects at the same time.

2. Description of the Related Art

The use of cleaning compositions to remove organic deposits is well known in the prior art. Effective removal of organic deposits is a considerable problem, which in the past has required the use of highly corrosive, unsafe cleaners, typically based on highly alkaline caustics such as sodium or potassium hydroxide, sometimes accompanied by laborious scrubbing and/or scraping.

Further, caustic cleaners require substantially elevated temperatures to work effectively and are extremely difficult to remove by rinsing. Many caustic cleaners, such as those incorporating sodium hydroxide, damage the skin of the user and produce hazardous fumes. Such caustic cleaners can also scar, damage and even destroy many types of surfaces. The use of these products also raises serious hazards to the skin and eyes of the user.

Another problem presented by the use of these products is that the chemicals fill the air of the building in which they were used causing eye, nasal, and lung irritation. After the cleaning solution dries, then the residual chemical and mineral precipitates (solids) flake off and become airborne, and further irritate eyes, nose, lungs, and skin. The aforesaid residual chemicals and mineral precipitates may trigger allergies, asthma attacks, and other sinus and respiratory problems.

To avoid the problems associated with caustic cleaners, non-caustic cleaners, which are typically not as effective as caustic cleaners, are employed in many applications. Because of the reduced effectiveness of the non-caustic cleaners, additional time and labor is required to remove organic deposits. Non-caustic cleaners are sometimes initially used to remove a portion of the organic deposits with the remainder being removed by caustic cleaners. In this manner, the use of caustic cleaners is reduced as much as possible.

Another problem encountered with the prior art is that while organic deposits are generally easy to remove from relatively flat surfaces, it is very difficult to remove the organic deposits from cracks, crevices, corners, passages, and other hard-to-reach places.

In view of the difficulty of the cleaning compositions discussed above to access or adequately clean hard to reach surfaces of a substrate, there has been a recent trend to employ liquid cleanser that breaks down and removes residue or scale in the hard to reach surfaces.

A problem presented with these liquid compositions is that they merely provide a pre-soaking treatment and require brushing to remove deposits. Thus, areas not reached by a brush are not cleaned. This problem becomes acute in the case of convoluted or sharp angled corners, passages, or other pieces.

The prior art compositions require soaking for at least about one-half hour and constant scrubbing for satisfactory removal of the deposit, which is particularly difficult to achieve in hard-to-reach places.

For example, U.S. Pat. No. 5,858,106 entitled "Cleaning Method for Peeling and Removing Photoresist" to Ohmi et al., teaches a cleaning liquid composition comprised of pure water, isopropyl alcohol, and hydrofluoric acid, ammonium fluoride, or potassium fluoride. The cleaner is used to peel organic films such as photoresists off of a semiconductor. The cleaning liquid is used together with ultrasound. A problem presented with this reference is that the cleaner is potentially toxic, and would be difficult for the average consumer to use.

Another cleaner is disclosed in U.S. Pat. No. 5,041,235 "Liquid Hard Surface Cleaner for Porous Surfaces" to Kilbarger. This patent discloses a liquid hard surface cleaner for porous surfaces. The composition contains a surfactant, a synthetic hydrocarbon oil, and an aliphatic alcohol. This composition, is used for hard to reach surfaces, but presents the problem that it leaves a residue on the internal surfaces of the substrate.

Finally, U.S. Pat. No. 4,496,667 entitled "Method for Cleaning Organically Fouled Anion Exchange Resins" to Reichgott et al. discloses cleaning organically fouled anion exchange resins by first pre-soaking the resins in a brine-caustic solution for one hour, rinsing with distilled water, soaking in a brine-caustic 30% isopropanol solution for one hour, rinsing, and repeating the second soaking step. The use of a one to four carbon monohydric alcohol in the second soaking step was found to provide a 100% improvement in resin removal. This process is both time-consuming (taking at least three hours) and complex.

The present inventor became familiar with the various commercially available liquid cleansers, and felt that the long period of soaking was a significant inconvenience. Determined to find a better liquid cleanser, the inventor began experimenting with various household detergent products, such as glass cleaners, tile cleaners, carpet cleaners, etc. He quickly realized that most of these products could be eliminated from consideration due to the unpleasant and possibly toxic residues left behind after cleaning.

Accordingly, the present inventor felt a need for a non-hazardous cleaning composition for removing organic deposits that is safe to use and will not damage the surfaces to be cleaned. Particularly, he felt that there is a need to provide a cleaning composition that will not damage the skin of the user.

Also, there is a need for a non-toxic cleaning composition that does not leave a visible residue.

Further, there is a need for a non-toxic product, which can be used for users having allergy problems.

Further, it can be appreciated that there exists a need for a cleansing composition for cleaning and disinfecting hard to reach surface of a substrate that is capable of removing organic deposit on the hard to reach surface quickly and in a single cleaning cycle.

Finally, there remains a need in the art for cleaning compositions which include an abrasive that exhibits improved performance, is less expensive, easy to handle, easy to disperse in the substrate and would not leave residue in the hard to reach surface or the substrate.

SUMMARY OF THE INVENTION

It is therefore an object of the present invention to provide a cleaning composition that represents a vast improvement over the above-discussed cleaning compositions.

It is yet another object of the invention to provide cleaning compositions, which effectively remove organic deposits on hard to reach surfaces without having a detrimental effect on the substrate.

It is yet another object of the present invention to provide a cleaning composition which achieves cleaning and disinfecting in a much shorter time, without scrubbing, as compared to conventional cleaning compositions.

It is yet another object of the present invention to provide a cleaning composition that does not leave a visible residue.

It is yet another object of the present invention to provide a cleaning composition that can be used by users having allergy problems or customer that prefer natural product.

The present inventor surprisingly found that a stable, easy to rinse cleaning composition that overcomes or minimizes the drawbacks of the prior art, could be prepared by combining a water miscible solvent, such as alcohol, a salt in solid form and water.

In the present invention, the amount of the inorganic salt is at least 20% of the total composition by weight, with at least some of the salt existing in crystalline form at 20° C. The maximum desired amount of the inorganic salt in crystalline form is about 70% of the total composition by weight at 20°.

The salt must have high solubility in water, and a low solubility in alcohol in order to provide the abrasion effect and be easily rinsable with water.

Due to the high solubility of salt in water (and poor solubility in alcohol), as the proportion of alcohol is increased, the lower the amount of salt needed to ensure presence of crystalline salt in the final composition. As the proportion of water is increased (and the proportion of alcohol is correspondingly decreased), the proportion of salt must also be increased in order to ensure the presence of inorganic salt in crystalline form in the final composition.

The inventor found to be an advantageous property of the composition of the present invention that the salt, which serves as a mechanical abrasive, does not clog the interior surfaces of the substrate; this being due to the water solubility of the salt resulting in the complete removal of any residual salt during the final step of rinsing the substrate after cleaning. Any other solid abrasives, in comparison, would stick to the organic deposits in the interior surfaces of the substrate and clog even zigzagged internal passages.

The solid salt must be of such hardness that it does not damage the surface of the substrate, but will nevertheless remove the organic deposit layers. Preferably the hardness is not greater than 5 on the Mohs scale.

The inventor also found out that a superior cleaning could be achieved in a very short period of time (about 20 seconds), without scrubbing, due to the interaction of the combination of the alcohol and the presence of the salt in crystal form. When the article to be cleaned is shaken, the crystal of the salt imparts a mechanical cleaning effect and supplements the chemical effects of the alcohol, and at the same time, the alcohol disinfects the surface being treated.

This represents a significant improvement over the prior art cleansing solutions, which required a minimum of one-half hour to soak, required scrubbing, and which are often not designed to disinfect. Further, in accordance with the present invention, it is only necessary to expose the internal surfaces (hard to reach surfaces) of the substrate to the cleansing composition and shake the article to be cleaned. This represents a significant savings over cleansing compositions that instruct the user to immerse the entire substrate in the cleansing solution.

The prior art cleansing solutions are thus not only comparatively ineffective in cleaning and sanitization ability, but they are annoying to use, and further require large quantities in order to immerse the device being cleaned, and thus are associated with significant cost.

The cleaning composition of the present invention in its basic form comprises:

a) a water miscible solvent;

b) an inorganic salt; and c) water;

wherein the amount of the inorganic salt is at least 20% of the total composition by weight, with at least some of the salt existing in crystalline form at 20° C.

The liquid portion of the composition comprises from about 30 to about 80% of the total composition by weight. The inorganic salt comprises, at 20° C., from 20% of the total composition by weight, with at least some of the salt existing in crystalline form, to a maximum amount of about 70% of the total composition by weight, in crystalline form.

In a preferred embodiment, the amount of the inorganic salt is 20% to 49% of the total composition by weight, with at least some of the salt existing in crystalline form at 20° C. In another preferred embodiment, the amount of the inorganic salt in crystalline form at 20° C. is about 30% to a maximum of about 70% of the total composition by weight, preferably from 40% to 53% of the total composition by weight.

The water miscible solvent: water ratio in the final composition is preferably in the range of from 9:1 to 2:1, preferably 8:1 to 5:1.

In a second preferred embodiment the cleaning composition for removing organic deposit comprises:

a) a water miscible solvent;

b) an inorganic salt;

c) water;

d) a terpene;

e) an anti-bacterial agent; and f) at least one surfactant selected from the group consisting of anionic surfactant, non-ionic surfactant, amphoteric surfactant and mixtures thereof;

wherein the amount of the inorganic salt is at least 20% of the total composition by weight, with at least some of the salt existing in crystalline form at 20° C.

The present inventor also discovered that the defects of prior art liquid cleaning composition can be minimized or overcome through the incorporation therein of a specified level of a terpene material in combination with a polar solvent of specified water-solubility characteristics.

Although the terpenes, as a class, have limited water-solubility, it has now been found that they can be incorporated into liquid cleaning compositions in homogeneous form with the ability to provide excellent cleaning characteristics across the range of water hardness or grease/oily soils and inorganic particulate soils, as well as on shoe polish, marker ink, bath tub soil, etc, and excellent shine performance with low soil re-deposition and little or no propensity to cause filming, streaking, or spotting on surfaces washed therewith.

A notable feature of the instant composition is the suds-suppression effectiveness of the terpenes in liquid compositions based on surfactants. Thus, it is notoriously difficult to control the sudsing behavior of the surfactants in a cost-effective manner using conventional suppression agents such as soaps, waxes, etc. The terpenes are thus particularly valuable in this respect.

The second embodiment further includes an antibacterial agent. The introduction of an antibacterial into the equation results in additional problems for cleaning efficacy. For example, triclosan has very poor solubility in alcohol and generally requires the presence of surfactant to solubilize it, but certain surfactants have deactivating effects on the de-germing properties of the antibacterial agent.

Accordingly, the surfactant system in the formulation of the present invention comprises a synergistic mixture of two or more surfactants. A first surfactant is selected for high solubilization of hydrophobic antibacterial agent, e.g., triclosan and the terpene. A second surfactant acts to aid in the solubilization of the first surfactant in the solvent, such that the total amount of surfactants is minimized. This two-stage solubilizing effect is important as it aids in the long-term shelf stability of the formulation.

The concentration of surfactant in the overall composition is dependent on a number of factors including the concentration of the alcohol, the concentration of the terpene, and the concentration of the antibacterial agent.

The addition of water miscible solvent to the composition assists in improving the dispersability and/or miscibility of the terpene and antibacterial agent in the composition.

It has also been surprisingly found that the composition of the present invention has a very high disinfecting property; this believed to be attributable to the high concentration of water miscible solvent and terpene.

In a third preferred embodiment, the present invention felt the necessity to provide a cleaning composition that was just as fast and effective as his previous compositions, but with less alcohol and more natural ingredients in other to satisfy customers with allergy problems or customers that prefer natural products.

In this embodiment, the water miscible solvent was limited to an alcohol derived from natural resources, such as SD 40 alcohol, and a terpene from a natural source, such as D-limonene.

It is essential that all the compositions of the present invention provide a sufficient amount of a salt in crystalline form, as an abrasive agent, which provides improved cleaning characteristics, specially in the hard to reach surfaces, with little tendency to cause filming or streaking on washed surfaces. Importantly, the abrasives used herein are non-detrimental to surfaces cleansed with the present compositions.

The cleaning composition has a number of other advantages relative to existing cleaners. In some applications, the cleaning composition provides an all-purpose cleaner that can replace existing caustic and non-caustic cleaners. The cleaning composition thereby reduces the labor and time required to clean the substrate. The cleaning composition is environmentally benign.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

DETAILED DESCRIPTION OF THE INVENTION

The present invention comprises in its basic a cleaning composition for removing organic deposit comprising:

a) a water miscible solvent;

b) an inorganic salt; and c) water;

wherein the amount of the inorganic salt is at least 20% of the total composition by weight, with at least some of the salt existing in crystalline form at 20° C.

The liquid portion of the composition comprises from about 30 to about 80% of the total composition by weight. The inorganic salt comprises, at 20° C., from 20% of the total composition by weight, with at least some of the salt existing in crystalline form, to a maximum amount of about 70% of the total composition by weight, in crystalline form.

In a preferred embodiment, the amount of the inorganic salt is 20% to 49% of the total composition by weight, with at least some of the salt existing in crystalline form at 20° C. In another preferred embodiment, the amount of the inorganic salt in crystalline form at 20° C. is about 30% to a maximum of about 70% of the total composition by weight, preferably from 40% to 53% of the total composition by weight.

This unique combination of ingredients possesses unexpectedly superior organic residue removal and sterilization properties as compared to properties possessed by the several ingredients individually.

Surprisingly, superior cleaning can be achieved in a very short period of time (20-60 seconds) due to the combination of the alcohol and the presence of brine in crystal form. The crystalline salt imparts a mechanical cleaning effect and supplements the chemical effects of the alcohol and brine. The combination of the alcohol and crystalline salt produces an unexpectedly rapid and superior de-scaling and disinfecting of the internal surfaces of a substrate, and can produce excellent results in as little as 20-60 seconds without brushing. This represents a significant improvement over the prior art cleansing solutions, which required a minimum of one-half hour of soaking, followed by scrubbing, and which are not designed to disinfect.

Further, in accordance with the present invention, it is only necessary to expose the internal surfaces of the substrate to the cleansing composition. This represents a significant savings over cleansing compositions that instruct the user to immerse the entire substrate in the cleansing solution.

The proportion of water that may be present in the final composition and be within the scope of the invention can be functionally determined. If insufficient water is present, there is an insufficient formation of brine, and the effectiveness of the cleansing composition is reduced. As the proportion of water is increased, the water content will eventually reach a point at which the solubility for salt is too great, excessive amounts of salt will dissolve, and crystals will not be present in the cleansing composition. Accordingly, the water miscible solvent: water ratio in the final composition is preferably in the range of from 9:1 to 2:1, preferably 8:1 to 5:1.

Salt (Abrasive)

The salt must have high solubility in water, and a low solubility in water miscible solvent in order to provide the abrasion effect and be easily rinsable with water.

Due to the high solubility of salt in water (and poor solubility in water miscible solvent), as the proportion of alcohol is increased, the lower the amount of salt needed to ensure presence of crystalline salt in the final composition. As the proportion of water is increased (and the proportion of alcohol is correspondingly decreased), the proportion of salt must also be increased in order to ensure the presence of inorganic salt in crystalline form in the final composition.

Due to the presence of undissolved salts in the composition of the present invention, the composition is referred to as a composition and not as a solution.

The crystal of the salt, which acts as an abrasive, aids in breaking up the mass of organic deposit much more rapidly than a composition without an abrasive.

The water-soluble salt is preferably an inorganic salt, normally possessing not more than a single hydrated species when present as a crystalline solid in water at a temperature of from 10 to 40° C. in an amount in excess of that required to form a saturated solution. Exemplary inorganic salts, which can be used in the present invention, have the following physical-chemical characteristics:

| | | | |
|---|---|---|---|
| Sodium Chloride | NaCl | mwt. 58.4428 | sp. gr. 2.165 |
| Sodium Bromide | NaBr | mwt. 102.90 | sp. gr. 3.203 |
| Magnesium Bromide | $MgBr_2$ | mwt. 184.13 | sp. gr. 3.72 |
| Magnesium Chloride | $MgCl_2$ | mwt. 95.22 | sp. gr. 2.316 |
| Potassium Chloride | KCL | mwt. 74.54 | sp. gr. 1.984 |
| Potassium Bromide | $KBr_2$ | mwt. 119.01 | sp. gr. 2.75 |
| Zinc Chloride | $ZnCl_2$ | mwt. 136.30 | sp. gr. 2.91 |

Preferably, the water-soluble salt will have a Mohs hardness of at least 2 and less than 5.

The salt will also have solubility in water of at least 5 g/l at 10° C., to ensure that any surplus salt can readily be rinsed from a hard surface after cleaning with the composition. In this way, the surface can be free from residual spots or streaks.

Preferably, the present invention uses sodium chloride.

The advantages of employing sodium chloride are that:

a) it is cheap and readily available;

b) it is non-toxic and does not harm the surface;

c) its solubility in water does not vary much over the normal product storage temperature, ensuring that an excess of it will remain undissolved in the cleaning composition to provide abrasive properties, whereas it is sufficiently soluble in water to dissolve, when finally rinsed with water, a hard surface that has been cleaned with the cleaning composition;

d) the crystalline form is sufficiently hard to exhibit good cleaning qualities, but it is less likely to scratch a hard surface to the degree that can occur when using other abrasive ingredients; and e) sodium chloride is an advantageous abrasion material in cleaning compositions because it is not characterized by sharp rigid edges, and therefore will not produce micro-cuts on the surface of the substrate during use, as can occur with other salts.

The solubility of sodium chloride in ethyl alcohol at room temperature (25° C.) is only 0.065 g/100 g alcohol. The solubility in methyl alcohol is 1.4 g/100 g alcohol.

The inorganic salt comprises, at 20° C., from 20% of the total composition by weight, with at least some of the salt existing in crystalline form, to a maximum amount of about 70% of the total composition by weight, in crystalline form.

In a preferred embodiment, the amount of the inorganic salt is 20% to 49% of the total composition by weight, with at least some of the salt existing in crystalline form at 20° C. In another preferred embodiment, the amount of the inorganic salt in crystalline form at 20° C. is about 30% to a maximum of about 70% of the total composition by weight, preferably from 40% to 53% of the total composition by weight.

Water Miscible Solvent

The water-miscible solvent useful in the present invention can be selected from aliphatic alcohols, glycol ethers, and mixtures thereof. Examples of alcohols useful in the present invention are the lower $C_1$-$C_8$ mono-, di-, and tri-alcohols, such as ethanol, propanol, isopropanol, and propane-1,3-diol. Suitable glycol ethers are the alkylene and dialkylene glycol mono-C.sub.1-C.sub.4 alkyl ethers where the alkylene group is preferably ethylene or propylene and the dialkylene group is preferably diethylene or dipropylene. Most preferably, a lower carbon alcohol is used.

Exemplary lower carbon alcohols, which can be used in the present invention, have the following physical-chemical characteristics:

| | | |
|---|---|---|
| Ethanol | $CH_3CH_2OH$ | mwt. 46.0 |
| Methanol | $CH_3OH$ | mwt. 32.03 |
| Isopropanol | $CH_3CHOHCH_3$ | mwt. 60.09 |

The cleansing composition preferably comprises from about 15 to about 50%; preferably from about 20 to about 40% of the total weight of the composition.

The present invention in another form has an organic solvent comprising from 20 to about 30 wt. % of the total composition, an inorganic salt comprising from 20 to about 49 wt. % of the composition, octoxynol-9 comprising from about 0.5 to 3 wt. % of the composition, a fragrance comprising from about 0.01 to 2 wt. % of the composition, a dye comprising from about 0.01 to 2 wt. % of the composition, and distilled water comprising from about 40 to 70 wt. % of the composition.

Other Ingredients

Fragrance and color are inert with respect to cleaning formulation, and are added to the composition to create a recognizable appearance and smell, and to make the composition more appealing to the consuming public.

For example, FD & C Yellow No. 5 is a yellow dye and FD & C Blue No. 1 is a blue dye with both dyes certified to comply with specifications published in the U.S. Code of Federal Regulations for Food, Drug and Cosmetic Colors.

In the second preferred embodiment, the present invention comprises a cleaning composition for removing organic deposit comprising:

a) a water miscible solvent;

b) an inorganic salt;

c) water;

d) a terpene;

e) an anti-bacterial agent; and f) at least one surfactant selected from the group consisting of anionic surfactant, non-ionic surfactant, amphoteric surfactant and mixtures thereof;

wherein the amount of the inorganic salt is at least 20% of the total composition by weight, with at least some of the salt existing in crystalline form at 20° C.

This composition may be sold as a concentrate formula, which will be diluted by the consumer.

As compared with the basic embodiment, the second embodiment includes the addition of a terpene, an increase in the amount of octoxynol-9, which, as explained in the summary section, adds great cleaning power to the formulation. The amount of water miscible solvent was lowered because the combination of the terpene, octoxynol-9 and water miscible solvent will provide the same results even if the amount of the water miscible solvent has been lowered.

Terpenes

Preferred terpenes are mono- and bicyclic monoterpenes, especially those of the hydrocarbon class, which include the terpinenes, terpinolenes, limonenes and pinenes, and mixtures thereof. Highly preferred materials of this type are d-limonene, dipentene, alpha-pinene, beta-pinene and the mixture of terpene hydrocarbons obtained from the essence of oranges (e.g., cold-pressed orange terpenes and orange terpene oil phase ex fruit juice).

Citrus terpenes, including orange terpenes and d-limonene, are safe, effective, and naturally occurring organic solvents currently used as a fragrance additive in various soap products and perfumes, and as well as a flavor additive in foodstuffs and beverages. Because, for example, d-limonene is an effective organic solvent, it is also utilized in household and industrial cleaning products and is a viable alternative to potentially dangerous chlorinated hydrocarbon solvents.

D-limonene is a naturally occurring biodegradable solvent found in the oil of citrus peels of limes, lemons, and oranges to mention just a few sources. D-limonene provides good solvent power and has a Kauri-Butanol (K-B) value of about 62.7, which is indicative of its high solvent strength. Odorless mineral spirits by comparison have a K-B value of about 26. Since d-limonene is a safe and effective organic solvent, it is currently utilized in household and industrial cleaning products.

D-limonene is a member of the chemical class known as dipentenes. Dipentenes, other than d-limonene, which also exhibit exceptional solvent power, are derived from pine trees. The dipentenes in turn are part of a more general class of chemicals called citrus terpenes, which as a group is characterized by strong solvent power. Some cuts of orange oil are sold as "orange terpenes" and function in an identical manner to the d-limonene organic solvent used in many of the representative examples disclosed below. Citrus terpenes are also part of the terpene family, members of which are used in the present invention. Therefore, those skilled in the art will readily understand that terpenes other than d-limonene may be used as the organic solvent in the cleansing composition of the present invention.

D-limonene dissolves hydrocarbon-based soils. However, while 100% d-limonene or a d-limonene/water mixture will slowly dissolve many organic deposits, the deposit will simply move around on the surface and not readily rinse off. Therefore, a viable cleaning composition having d-limonene or other terpenes preferably includes a surfactant.

The quantity of the terpene is in the range from about 2.5% to about 20% by weight based on the total weight of the composition.

Antibacterial Agent

The antibacterial agent is present in the formulation in quantities effective to inhibit the growth and/or kill bacteria on the surface. Although various known antibacterial agents can be employed, such as chloroxylenol and the halogenated carbanilides, the antibacterial agents employed in the present invention are generally halo-substituted dihydric phenol compounds and most preferably, a dihydric phenol 2,4,4'-trichloro-2'-hydroxydiphenyl ether (triclosan).

The antibacterial agent is present in the formulation in an amount of from about 0.01% to about 3.0% by weight based on the total composition.

Triclosan has a broad-spectrum activity against a variety of microorganisms. However, triclosan has very poor solubility in water and generally requires formulation additives to solubilize it. To solubilize triclosan, it is conventional to use a surfactant.

Surfactants

The surfactant system in the formulation of the present invention comprises a synergistic mixture of two or more surfactants. A first surfactant is selected for high solubilization of hydrophobic antibacterial agent, e.g., triclosan and the terpene. A second solvent acts to aid in the solubilization of the first surfactant in the solvent, such that the total amount of surfactants is minimized. This two-stage solubilizing effect is important as it aids in the long-term shelf stability of the formulation.

The preferred amount of surfactant varies to some degree with the class of surfactant employed, the concentration of water miscible solvent, the concentration of the terpene and the concentration of the anti-microbial agent.

The amount of surfactant(s) in the present invention is from about 0.05% to about 10%, preferably from about 0.25 to about 6.0% by weight based on the total composition.

Anionic Surfactants

The anionic surfactant which is employed in the aqueous liquid composition is any high lathering anionic surfactant such as a long chain sulfate, sulfonate, isethionate, carboxylate, taurate, sulfosuccinate, phosphate, and the like. Alkoxylated, preferably ethoxylated materials, are even more preferred. The most preferred material is an alkyl sulfate having an average of about 8 to 16 carbon atoms, preferably an average of 10 or 12 carbon atoms, most preferably normal alkyl. It is preferred that this material be ethoxylated with 1 to 4, preferably 2 or 3, average number of ethoxy groups. The cation is preferably an alkali metal or amine such as sodium, potassium, or triethanolamine, most preferably triethanolamine.

Preferred additional anionic surfactants for use in the present invention include alkyl glyceryl ether sulfonate, ammonium lauryl sulfate, ammonium laureth sulfate, triethylamine lauryl sulfate, triethylamine laureth sulfate, triethanolamine lauryl sulfate (Standapol T), triethanolamine laureth sulfate, monoethanolamine lauryl sulfate, monoethanolamine laureth sulfate, diethanolamine lauryl sulfate, diethanolamine laureth sulfate, lauric monoglyceride sodium sulfate, sodium lauryl sulfate, sodium laureth sulfate, potassium lauryl sulfate, potassium laureth sulfate, sodium lauryl sarcosinate, sodium lauroyl sarcosinate, lauryl sarcosine, cocoyl sarcosine, ammonium cocoyl sulfate, ammonium lauroyl sulfate, sodium cocoyl sulfate, sodium lauroyl sulfate, potassium cocoyl sulfate, potassium lauryl sulfate, triethanolamine lauryl sulfate, triethanolamine lauryl sulfate, monoethanolamine cocoyl sulfate, monoethanolamine lauryl sulfate, sodium tridecyl benzene sulfonate, octoxynol or nonoxynol phosphates, sodium dodecyl benzene sulfonate, and combinations thereof.

Examples of preferred anionic surfactants may include sodium lauryl sulphate, octoxynol or nonoxynol phosphates, sodium dodecylbenzene sulphonate, sodium lauroyl sarcosinate, and sodium coconut monoglyceride sulphonate.

Amphoteric Surfactants

The present invention uses the amphoteric surfactant preferably as a co-active surfactant. The preferred amphoteric surfactant will be a betaine, preferably selected from the group consisting of amidocarboxybetaines, alkyl betaines, amidopropyl betaines, amidopropyl sultaines, and sulfobetaines. In the present invention, the preferably amphoteric surfactant is amidocarboxybetaines, particularly cocoamidodimethylcarboxymethylbetaines (COCOMIDOPROPYL-BETAINE), such as those sold by Goldschmidt Co. under the trade name Tegobetaine.

Nonionic Surfactant

The cleaning composition also can contain nonionic surfactants. Typically, a nonionic surfactant has a hydrophobic base, such as a long chain alkyl group or an alkylated aryl group, and a hydrophilic chain comprising a sufficient number (i.e., 1 to about 30) of ethoxy and/or propoxy moieties. Examples of classes of nonionic surfactants include ethoxylated alkylphenols, ethoxylated and propoxylated fatty alcohols, polyethylene glycol ethers of methyl glucose, polyethylene glycol ethers of sorbitol, ethylene oxide-propylene oxide block copolymers, ethoxylated esters of fatty (C.sub.8-C.sub. 18) acids, condensation products of ethylene oxide with long chain amines or amides, and mixtures thereof.

Preservatives

In order to prevent degradation and to extend the shelf life of the cleansing formulations, preservatives are included in the composition to prevent deterioration due to potential microbial contamination or decomposition through oxidation with air. Examples of antimicrobial preservatives, which may be used in the formulations, include methylparaben, propylparaben, diazolidinyl urea (Trade-name Germall II, Sutton Chemical), and polymethoxy bicyclic oxazolidine (Trade-name Nuosept C, Huls America). For example, a commercial preservative blend, which may be used in the present invention, is sold under the tradename Germaben II by Sutton Chemical and is a solution of diazolidinyl urea, methylparaben and propylparaben in propylene glycol.

Alternative anti-microbial preservatives which may be used include other derivatives of para-hydroxybenzoic acid such as a blend of Isopropylparaben and isobutylparaben and butylparaben; 2-bromo-2-nitropropane-1,3-diol; methyldibromo glutaronitrile and phenoxyethanol. Other anti-microbial preservatives include formaldehyde, imadazolidinyl urea, quaternium-15, phenoxyethanol, chloroxylenol, DMDM Hydantoin, and a blend of methylchloroisothiazolinone and methylisothiazolinone.

Anionic and cationic surfactants are generally the primary surfactant in cleansing compositions to give foaming and detergency. The cleaning compositions disclosed herein are unique because they use nonionic surfactants as the primary surfactant system in which the brine is stable. The loss of foaming is advantageous because it enhances the scrubbing effect of the brine. However, the loss of detergency due to the lack of anionic or cationic surfactants is compensated for by the use of the terpene, which enhances the detergency of the nonionic surfactants.

In the third preferred embodiment, the present inventor felt the necessity to provide a cleaning composition that was just as fast and effective as his previous compositions, but with less alcohol and more natural ingredients in order to satisfy costumers with allergy problems or customers that prefer natural ingredients.

In this embodiment, the alcohol was replaced by an alcohol derived from natural resources such as SD 40 alcohol, and a terpene from natural source was used, such as D-limonene.

The present invention will be better understood from the examples, which follow. The below examples are illustrative of the preferred organic solvent and inorganic salt, and are intended to be illustrative only and not meant to unduly limit the scope of the invention. Unless otherwise indicated, percentages are on a percentage of composition basis.

It is essential that all the compositions of the present invention provide a sufficient amount of a salt in crystalline form, as an abrasive agent, which provide improved cleaning characteristics, specially in the hard to reach surfaces, with little tendency to cause filming or streaking on washed surfaces. Importantly, the abrasives used herein are non-detrimental to surfaces cleansed with the present compositions.

Example I

A cleaning composition was prepared having the following formulation.

| Component | wt. % |
|---|---|
| Isopropyl Alcohol | 47 |
| Sodium Chloride (crystal) | 37 |
| Deionized water | 13 |
| Fragrance | 1.5 |
| Dye | 1.5 |
| Total | 100 |

The composition was prepared by combining the organic solvent, the water, the fragrance, and dye with stirring until well blended. Then the finely divided salt crystals were slowly added, and again stirred to allow a small amount of the salt to dissolve into the solution. After preparation, the composition remained stable.

The composition was shaken and then poured into the interior surface of a substrate, and the substrate was vigorously agitated for about one minute. Shaking the composition allowed the organic salt to be evenly disbursed within the solution. The organic residue and scale deposited along the interior of the substrate was removed without damage to the substrate.

Example II

A cleaning composition was prepared having the following formulation.

| Component | % wt. |
|---|---|
| Isopropyl Alcohol | 36.0 |
| Sodium Chloride (crystal) | 49.45 |
| Deionized water | 8.75 |
| d-limonene | 3.9 |
| orange oil | 0.5 |
| Octoxynol-9 | 1.4 |
| Total | 100 |

The composition was prepared by combining the solvent, the water, the d-limonene, octoxynol, and orange oil with stirring until well blended. Then finely divided salt crystals were slowly added, and the mixture was again stirred to allow a small amount of the salt to dissolve into the solution. After preparation, the composition remained stable.

The composition was shaken and then poured into the interior surface of a substrate, and the substrate was vigorously agitated for about one minute. The organic deposit along the interior of the substrate was removed without damage to the substrate during each test.

Example III

A cleaning composition was prepared having the following formulation.

| Component | % wt. |
|---|---|
| Deionized Water | 23.8 |
| SD 40 Alcohol | 14.5 |
| D-limonene | 7.5 |
| Nonoxynol 9 | 2.0 |
| Nonionic Surfactant | 1.5 |
| Germaben 2 | 0.4 |
| Blue # 1 | 0.000088 |
| Yellow # 5 | 0.00121 |
| Triclosan | 0.25 |
| Sodium Chloride | 50.0 |
| Total | 100 |

The composition was prepared by combining the solvent, water, d-limonene, nonoxynol, nonionic surfactant, Germaben and dyes and antibacterial agent with stirring until well blended. Then finely divided salt crystals were slowly added, and the mixture was again stirred to allow a small amount of the salt to dissolve into the solution. It was noted that the increased amount of water caused a greater amount of salt to dissolve, but high amount of salt remained in crystalline form. After preparation, the composition remained stable.

The composition was shaken and then poured into the interior surface of a substrate, and the substrate was vigorously agitated for about one minute. The organic deposit along the interior of the substrate was removed without damage to the substrate during each test.

The cleaning compositions of the present invention thus facilitates the quick, efficient, and simple cleaning of hard to reach surfaces without a brush—eliminating the conventional time-consuming process which consists of soaking for at least one half hour, followed by scrubbing with a brush which does not result in sterilization of the device.

The inventive compositions are simply poured into the interior of the substrate, and the composition is agitated within the substrate for about one minute. The action of agitating the composition within the substrate allows the composition to have complete contact with the entire interior surface of the substrate. The crystal form of the inorganic salt acts as an abrasive and scours the interior walls of the substrate. The action of the inorganic salt against the interior surface of the substrate facilitates the removal of the accumulated scale and organic residue, which is softened by the solvent. Further, the cleaning composition disinfects any potentially harmful germs and bacteria within the substrate.

After cleaning the substrate, the composition may be disposed of by pouring down a sink. The material is easily washed down the drain because the composition is highly soluble in water.

As to the manner of usage and operation of the present invention, the same should be apparent from the above description. Accordingly, no further discussion relating to the manner of usage and operation will be provided.

With respect to the above description then, it is to be realized that the optimum proportional relationships for the ingredients of the composition, to include variation amounts of components by weight of the entire composition and manner of intermixing are deemed readily apparent and obvious to one skilled in the art, and all equivalent relationships to those described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A shake-to-clean composition, wherein said composition is a stable liquid-solid two-phase cleaning composition including abrasive grains of inorganic salt in crystalline form suitable for removing organic deposit from interior surfaces of a substrate, said cleaning composition comprising:

a. a water miscible solvent selected from the group consisting of one to five carbon mono-, di-, and tri-alcohols; alkylene glycol ethers; and dialkylene glycol ethers;

b. an inorganic salt; and c. water;

wherein the inorganic salt is present in an amount of 20% of the total composition by weight, with at least some of the salt existing in crystalline form at 20° C., to a about 70% of the total composition by weight in crystalline form at 20° C.; and wherein said water miscible solvent comprises from about 15-50% of the total composition by weight.

2. The cleaning composition according to claim 1, wherein said water miscible solvent is ethanol, propanol, isopropanol, propane-1,3-diol, diethylene glycol ether, propylene glycol ether, diethylene gycol ether, or dipropylene glycol ether.

3. The cleaning composition according to claim 1, wherein said water miscible solvent is a one to five carbon alcohol.

4. The cleaning composition according to claim 1, wherein the ratio of water miscible solvent:water is in the range of 9:1 to 2:1.

5. The cleaning composition according to claim 1, wherein the ratio of water miscible solvent:water is in the range of 8:1 to 5:1.

6. The cleaning composition according to claim 1, wherein said inorganic salt is selected from the group consisting of sodium chloride, sodium bromide, magnesium bromide, magnesium chloride, potassium chloride, potassium bromide, and zinc chloride.

7. The cleaning composition according to claim 1, wherein said inorganic salt is sodium chloride.

8. The cleaning composition according to claim 1, wherein the amount of said inorganic salt is from 20% to 49% of the total composition by weight.

9. The cleaning composition according to claim 1, wherein the amount of said inorganic salt in crystalline form is from about 30% to about 70% of the total composition by weight at 20° C.

10. The cleaning composition according to claim 1, wherein the amount of said inorganic salt in crystalline form is from 40% to 53% of the total composition by weight at 20° C.

11. A shake-to-clean composition, wherein said composition is a stable liquid-solid two-phase cleaning composition including abrasive grains of inorganic salt in crystalline form suitable for removing organic deposit from interior surfaces of a substrate, said cleaning composition comprising:

d. a water miscible solvent;

e. an inorganic salt;

f. water;

g. a fragrance; and h. a dye wherein the inorganic salt is present in an amount of 20% of the total composition by weight, with at least some of the salt existing in crystalline form at 20° C., to about 70% of the total composition by weight in crystalline form at 20° C.

12. The cleaning composition according to claim 11, wherein said water miscible solvent is selected from the group consisting of one to five carbon mono-, di-, and tri-alcohols; alkylene glycol ethers; and dialkylene glycol ethers.

13. The cleaning composition according to claim 11, wherein said water miscible solvent is a one to five carbon alcohol.

14. The cleaning composition according to claim 11, wherein said water miscible solvent comprises from about 15-50% of the total composition by weight.

15. The cleaning composition according to claim 11, wherein said inorganic salt is sodium chloride.

16. The cleaning composition according to claim 11, wherein the amount of said inorganic salt in crystalline form is from 20% to 49% of the total composition by weight.

17. The cleaning composition according to claim 11, wherein the amount of said inorganic salt in crystalline form is from about 30% to about 70% of the total composition by weight at 20° C.

18. The cleaning composition according to claim 11, wherein the amount of said inorganic salt in crystalline form is from 40% to 53% of the total composition by weight at 20° C.

19. The cleaning composition according to claim 11, wherein the ratio of water miscible solvent:water is in the range of 9:1 to 2:1.

* * * * *